US006731255B1

(12) United States Patent
Van Leeuwen et al.

(10) Patent No.: US 6,731,255 B1
(45) Date of Patent: May 4, 2004

(54) PROGRESSIVE SUSTAIN METHOD OF DRIVING A PLASMA DISPLAY PANEL

(75) Inventors: Gerrit Hendrik Van Leeuwen, Eindhoven (NL); Antonius Hendricus Maria Holtslag, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 158 days.

(21) Appl. No.: 09/612,070

(22) Filed: Jul. 7, 2000

(30) Foreign Application Priority Data

Jul. 10, 1999 (EP) ..... 99202273

(51) Int. Cl.[7] ..... G09G 3/28

(52) U.S. Cl. ..... 345/60; 345/61; 345/62; 345/63; 345/64; 345/65; 345/66; 345/67; 345/68; 345/69; 345/70; 345/71; 345/72; 345/204; 315/169.1; 315/169.4; 315/168

(58) Field of Search ..... 345/60, 72, 63, 345/68, 67, 204, 61, 62, 64, 65, 66, 69, 70, 71; 315/169.4, 169.1, 168

(56) References Cited

U.S. PATENT DOCUMENTS

| | | | | |
|---|---|---|---|---|
| 5,436,634 A | | 7/1995 | Kanazawa | 345/67 |
| 5,475,448 A | | 12/1995 | Saegusa | 348/797 |
| 5,825,675 A | * | 10/1998 | Want et al. | |
| 6,084,558 A | * | 7/2000 | Setoguchi et al. | 345/60 |
| 6,091,380 A | * | 7/2000 | Hashimoto et al. | 345/60 |
| 6,160,529 A | * | 12/2000 | Asao et al. | 345/60 |
| 6,169,527 B1 | * | 1/2001 | Kanazawa et al. | 345/60 |
| 6,288,692 B1 | * | 9/2001 | Kanazawa et al. | 345/67 |
| 6,337,674 B1 | * | 1/2002 | Kim | 345/66 |
| 6,344,841 B1 | * | 2/2002 | Moon | 345/60 |
| 6,384,802 B1 | * | 5/2002 | Moon | 345/60 |
| 6,424,325 B1 | * | 7/2002 | Van Dijk | 345/60 |

FOREIGN PATENT DOCUMENTS

| | | | |
|---|---|---|---|
| EP | 0762373 A3 | 3/1997 | G09G/3/28 |
| EP | 0762373 A2 | 3/1997 | G09G/3/28 |
| EP | 0855691 A1 | 7/1998 | G09G/3/28 |

* cited by examiner

*Primary Examiner*—Regina Liang
*Assistant Examiner*—Jennifer T. Nguyen

(57) ABSTRACT

A method of driving a plasma display panel showing images having frames composed of odd and even fields. The plasma display panel has scan electrodes and address electrodes perpendicular to the scan electrodes. In the method, first the odd and then the even scan electrodes, or vice versa, are addressed in the frame and subsequently sustained. This method saves time, which may be used to speed up the plasma display device.

15 Claims, 3 Drawing Sheets

PROGRESSIVE SUSTAIN METHOD OF DRIVING A PLASMA DISPLAY PANEL

BACKGROUND OF THE INVENTION

The present invention relates to a circuit and a method of driving a plasma display panel to show images composed of odd and even fields, the plasma display panel having address electrodes and scan electrodes perpendicular to the address electrodes.

The present invention also relates to a device provided with a plasma display panel and control means coupled to the plasma display panel.

Such a method and device are known from EP-A-0 762 373. The known method discloses a plasma display panel of the ALiS (Alternating Lighting in Surface) type having scan electrodes and address electrodes. During an image cycle comprising two fields, each being divided in a predetermined number of subfields, each subfield having an addressing and a sustaining period, in a first (odd) field, for each subfield plasma cells associated with odd row electrodes are first addressed and then sustained, whereas, in a second (even) field, for each subfield, cells associated with even row electrodes are first addressed and then sustained. Thus, one frame cycle comprises two fields: one odd field in which for every subfield the cells associated with the odd electrodes are addressed and sustained, and an even field in which for every subfield the cells associated with the even electrodes are addressed and sustained. Consequently, two sustaining actions are required for each subfield, which takes a considerable amount of time.

BRIEF SUMMARY OF THE INVENTION

It is an object of the present invention to provide a time-efficient method and device for performing scanning and sustaining.

To this end, the method according to the present invention is characterized in that both odd and even row electrodes, or vice versa, are addressed and subsequently sustained in the same frame.

It is an advantage of the method according to the invention that it provides a time-saving interlaced address and progressive picture sustain method, wherein, during each frame, all odd and even cells between the respective row electrodes are addressed and sustained. Consequently, one sustaining action per frame suffices for all rows, which saves one sustaining action per frame per subfield as compared with the prior art above. Thus, more light can be produced within a shorter time by said ALiS plasma display panel.

An embodiment of the method according to the invention is characterized in that, if one succession of odd and even row electrodes is addressed in a frame, the opposite succession of said row electrodes is addressed in an other frame. For example, in two successive frames, in the first frame, for every subfield, first the odd and then the even rows are addressed, then all rows are sustained, and in the second frame, for every subframe, first the even and then the odd rows are addressed, then all rows are sustained.

A particular selection of two address cycles from the four that the invention allows results in an equalization of the average amount of light produced in cells associated with odd or even row electrodes. If the odd row electrodes, followed by the even row electrodes are addressed in a first possible address cycle in a first frame, further referred to as odd frame, and the even row electrodes, followed by the odd row electrodes are addressed in a second frame, further referred to as even fame, then the negative effects of the order of addressing are compensated for, because these effects are averaged by the human eye. The same advantage holds for a second possible address cycle, wherein the even row electrodes, followed by the odd row electrodes are addressed in a first frame, and the odd row electrodes, followed by the even row electrodes are addressed in the second frame.

A further alternative embodiment of the method according to the invention is characterized in that the addressing is effected from top to bottom of the plasma display panel or possibly alternately from bottom to top. In particular, progressive addressing in odd frames is effected from top to bottom of the display panel, followed by sustaining, while progressive addressing in even frames is effected from bottom to top.

Consequently, the device according to the invention is cbaracterized in that the control means are controlled such that, in a given frame, odd ones of the scan electrodes are addressed without any of the odd ones being sustained, and then even ones of the scan electrodes are addressed without any of the odd ones or the even ones being sustained, or vice versa, and subscquently the odd ones and the even ones are sustained.

In one preferred embodiment, if one succession of odd and even row electrodes is addressed in one of the frames, the control means causes the opposite succession of the row electrodes to be addressed in another one of the frames. According to another embodiment, the control means causes addressing to be alternated such that in one of the frames the addressing is effected from top to bottom of the plasma display panel and in the next one of the frames from bottom to top.

The method and device according to the invention will now be elucidated, together with their additional advantages, while reference is made to the appended drawings, wherein similar components are denoted by the same reference numerals. In the drawings:

DETAILED DESCRIPTION OF THE INVENTION

Figure 1:
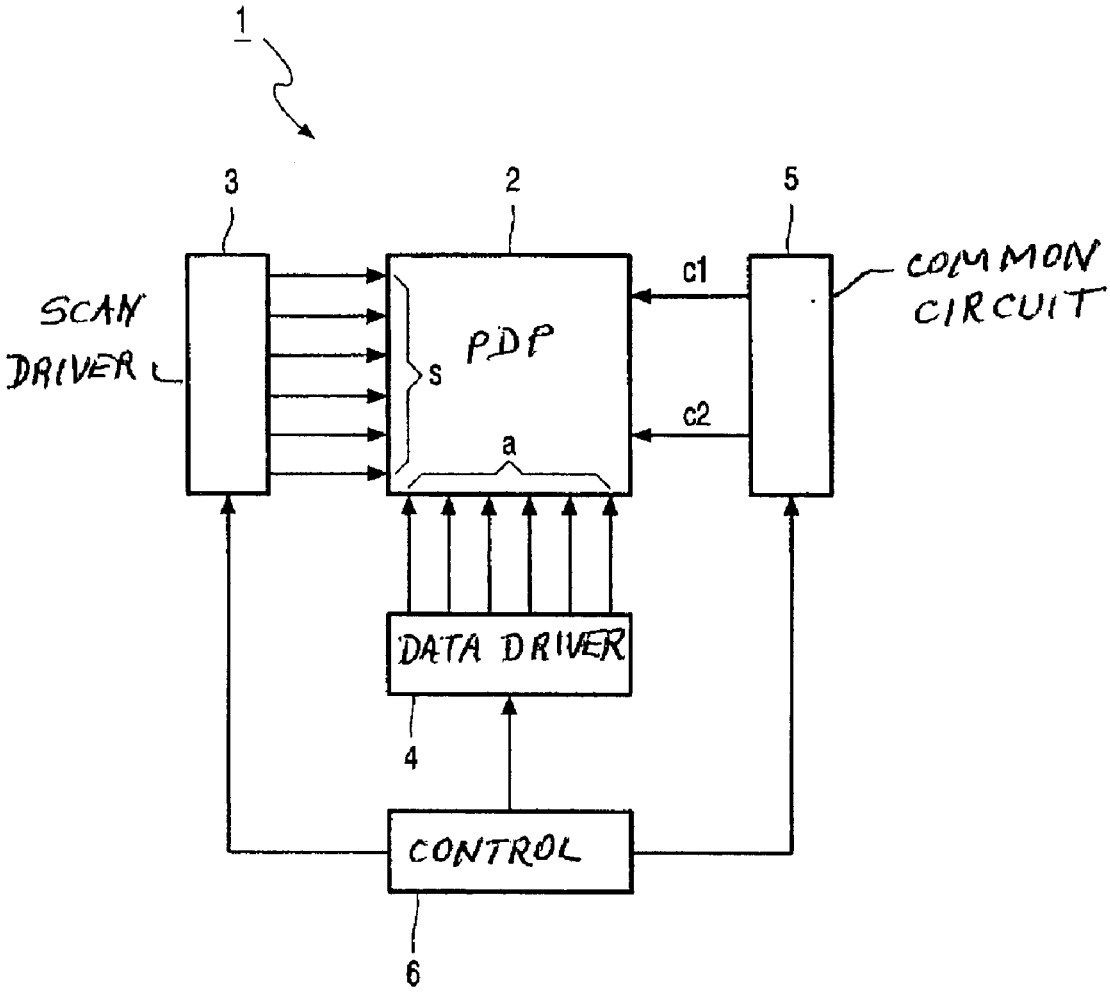
FIG. 1 shows a device according to the invention for performing the method according to the invention.

FIG. 1 shows a device 1 and the schematic structure of a plasma display panel (PDP) 2. The device 1 comprises a scan circuit or scan driver 3, an address circuit or data driver 4, and a common circuit 5, each coupled to a control circuit 6. The scan circuit 3 and the common circuit 5 are equipped with sustain circuits (not shown). The PDP 2 is of a type which comprises pixel cells for color or black and white imaging arranged in a matrix and provided with row electrodes in the form of scan electrodes s coupled to the scan circuit 3, and two pairs of common electrodes c1 and c2 coupled to the common circuit 5. In addition, the PDP 2 is provided with address electrodes indicated "a" which are coupled to the address circuit 4. The control circuit 6 is generally provided with a programmable means, such as a computer or microprocessor, which is programmed to perform an address and sustain sequence or cycle, which will be elucidated hereinafter.

Figure 2A:
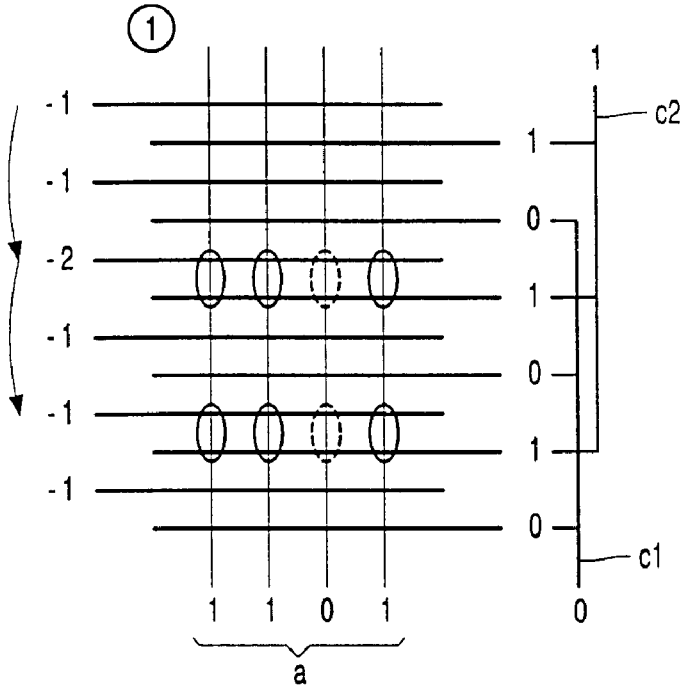
FIG. 2 shows one of the proposed possible address and sustain sequences in the method according to the invention.
Figure 2B:
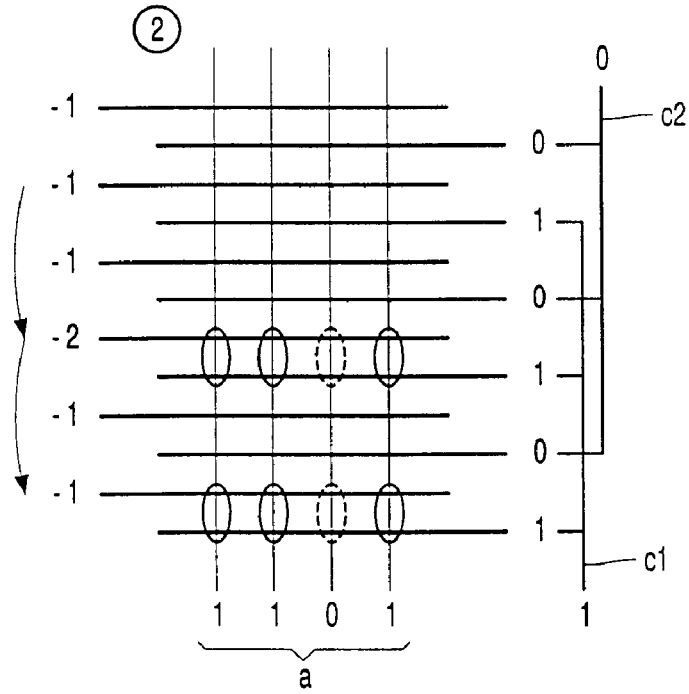
Figure 2C:
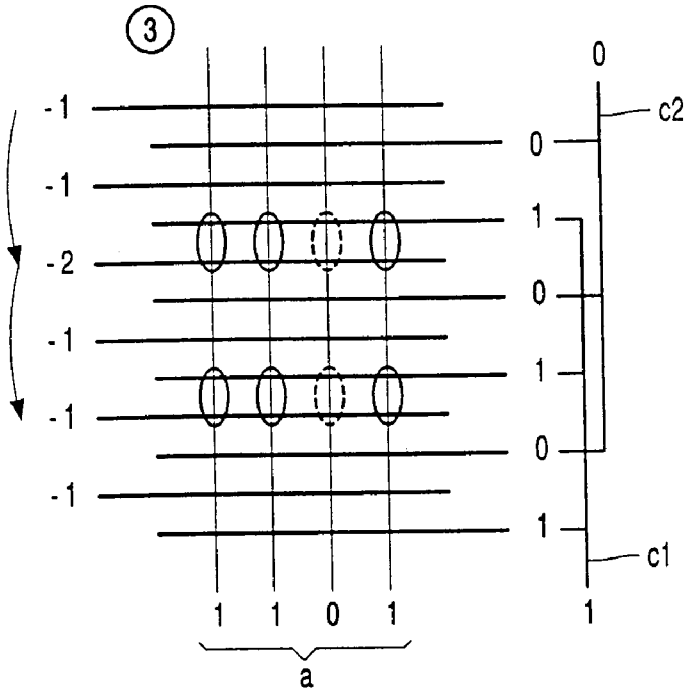
Figure 2D:
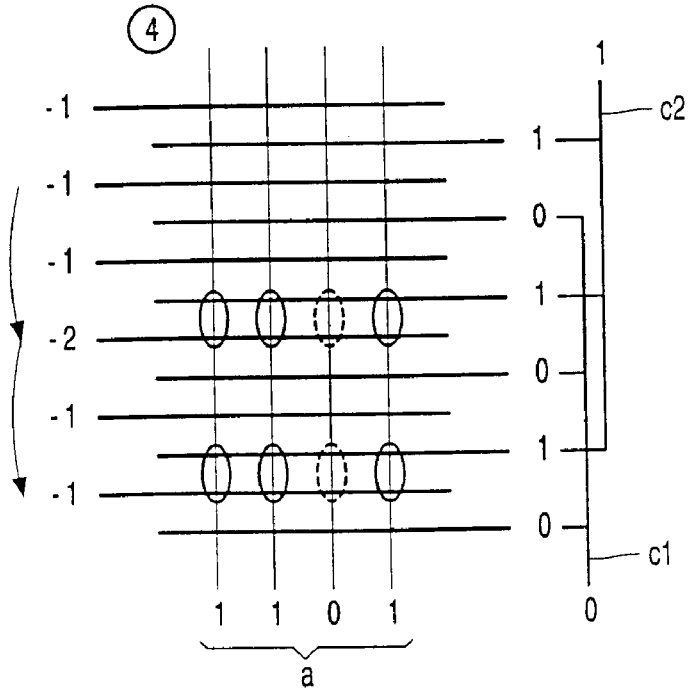

FIGS. 2A and 2B show the PDP 2 of FIG. 1 again, with reference to which particularly the scanning, addressing and sustaining sequence will be described. Initially, the whole PDP 2 is erased by erase means (not shown). During a sequence of interlaced imaging in a first frame, for example, the odd rows in the PDP 2 are scanned and provided with common signals as indicated in FIG. 2A. The scanning is effected by the scan circuit 3 under the control of the control circuit 6. Scanning with an appropriate voltage on the scan electrodes s is performed by applying a voltage, symbolically denoted by the relative value "−2" to the scanned electrode concerned. The other scan electrodes s are kept at the relative value "−1". Meanwhile, the address circuit 4 is controlled by the control means 6 to address the particular address electrodes a, whereas the pair of common electrodes c1 and c2 is controlled to apply the appropriate voltages, schematically denoted "0", and "1". In FIG. 2A, in the odd row formed by the scan electrode s with the relative value −2, the cells indicated in bold outline are actually addressed to emit light during the sustain period. The cells indicated in dashed outline are addressed to not emit light during the sustain period. In FIG. 2A the arrows on the left hand indicate the scan electrode s which subsequently receive the relative value −2 to scan the display row. In the situation shown, the upper display row of which the pixels are indicated by circles and of which the corresponding scan electrode s receives the relative value −2 are actually addressed. The lower display row of which the pixels are indicated by circles and of which the corresponding scan electrode s receives the relative value −1, is not addressed at the same time as the upper display row, but somewhat later if the rows are scanned from top to bottom. Subsequently, in the same way, further interleaving odd rows (see FIG. 2B) are addressed while the scanned electrode skips to the next odd row to apply "−2" thereto, while the voltages at c1 and c2 are interchanged. In this case, the same cells indicated in bold outline are actually addressed row by row to emit light. When all odd row electrodes are thus addressed similarly, all even row electrodes are successively scanned and addressed (see both FIG. 2C and FIG. 2D). Thereafter, all odd and even row electrodes are sustained simultaneously by the scan and common circuits 3 and 5, which are controlled for this purpose by the control circuit 6. In a second frame, the odd and even row electrodes are again addressed and all are sustained. Ultimately, in each frame, odd and even rows, or even and odd rows are consecutively addressed and then sustained. There are four possible ways of addressing consecutive frames, which addressing is followed in each frame by sustaining.

The four possibilities are:

(1) odd frame: address first the odd and then the even rows, sustain all rows; even frame: address first the odd and then the even rows, sustain all rows.

(2) odd frame: address first the even and then the odd rows, sustain all rows; even frame: address first the even and then the odd rows, sustain all rows.

(3) odd frame: address first the odd and then the even rows, sustain all rows; even frame: address first the even and then the odd rows, sustain all rows. ( 4) odd frame: address first the even and then the odd rows, sustain all rows; even frame: address first the odd and then the even rows, sustain all rows.

Possibilities (3) and (4) are preferred because an addressing followed by a subsequent addressing of a neighboring cell leads to a partial overlap and re-addressing of the initially addressed cell, which partly obscures the production of light by the overlapped cell. This degrades an accurate imaging. By changing the order of addressing in a subsequent frame, the overlap, if any, is reversed, thus compensating negative effects caused by the overlap, which are now averaged by the human eye.

If desired, each of these possibilities can be combined with the alternative of the addressing taking place either from top to bottom of the plasma display panel or from bottom to top. These alternatives can be alternated in order to average any negative effect of overwriting a part of previously addressed plasma cells by later addressing of neighboring cells. In that case, an addressing from top to bottom is alternated by a subsequent addressing from bottom to top, or vice versa.

In usual plasma display panels, the address electrodes which carry the data bits to be display form the column electrodes, and the scan electrodes which take care of the addressing and sustaining form row electrodes. Nevertheless, the display may be rotated 90 such that the scan electrodes extend in the column direction.

What is claimed is:

1. A circuit for driving a plasma display panel to show images formed by a succession of frames, wherein each frame is composed of at least one odd field and at least one even field, the plasma display panel has address electrodes and scan electrodes perpendicular to the address electrodes, scan electrodes associated with an odd field being at least a first set identified as odd ones of the scan electrodes, and scan electrodes associated with an even field being at least a second set identified as odd ones of the scan electrodes, and the circuit comprises:

a scan driver coupled to the scan electrodes, a data driver coupled to the address electrodes, and a control circuit coupled to the scan driver and the data driver to control a timing thereof, characterized in that the control circuit is adapted to address said electrodes and sustain corresponding pixels forming a respective frame in the following order:

first address one of said sets of the scan electrodes, then address an other of said sets of the scan electrodes, and complete addressing of the sets of scan electrodes forming the respective frame before sustaining both the pixels corresponding with the odd and the even ones of the scan electrodes for the respective frame.

2. A method of driving a plasma display panel to show images having frames composed of odd and even fields, the plasma display panel having address electrodes and scan electrodes perpendicular to the address electrodes, characterized in that in a given frame odd ones of the scan electrodes are addressed without any of said odd ones being sustained, and then even ones of the scan electrodes are addressed without any of said odd ones or said even ones being sustained, or vice versa, and subsequently said odd ones and said even ones arm sustained.

3. A method as claimed in claim 2, characterized in that if one succession of odd and even row electrodes is addressed in one of the frames, the opposite succession of said row electrodes is addressed in an other one of said frames.

4. A device provided with a plasma display panel and control means coupled to the plasma display panel, characterized in that the control means are controlled to perform the method as claimed in claim 3.

5. A method as claimed in claim 3, characterized in that addressing is alternated such that in one of the frames the addressing is effected from top to bottom of the plasma display panel and in the next one of the frames from bottom to top.

6. A device provided with a plasma display panel and control means coupled to the plasma display panel characterized in that the control means arc controlled to perform the method as claimed in claim 5.

7. A method as claimed in claim 3, characterized in that addressing is alternated such that in one of the frames the addressing is effected from top to bottom of the plasma display panel and in the next one of the frames from bottom to top.

8. A device provided with a plasma display panel and control means coupled to the plasma display panel, characterized in that the control means are controlled to perform the method as claimed in claim 7.

9. A method as claimed in claim 2, characterized in that addressing is alternated such that in one of the frames the addressing is effected from top to bottom of the plasma display panel and in the next one of the frames from bottom to top.

10. A device provided with a plasma display panel and control means coupled to the plasma display panel, characterized in that the control means are controlled to perform the method as claimed in claim 9.

11. A device provided with a plasma display panel and control means coupled to the plasma display panel, characterized in that the control means are controlled to perform the method as claimed in claim 2.

12. A method as claimed in claim 2, characterized in that, for each frame, the entire plasma display panel is erased prior to addressing said scan electrodes.

13. A device provided with a plasma display panel and control means coupled to the plasma display panel, characterized in that the control means are controlled to perform the method as claimed in claim 12.

14. A method as claimed in claim 2, characterized in that if one succession of odd and even row electrodes is addressed in one of the frames, the opposite succession of said row electrodes is addressed in the next one of said frames.

15. A device provided with a plasma display panel and control means coupled to the plasma display panel, characterized in that the control means are controlled to perform the method as claimed in claim 14.

* * * * *